US006120560A

United States Patent [19]

Miller et al.

[11] Patent Number: 6,120,560

[45] Date of Patent: Sep. 19, 2000

[54] PROCESS AND APPARATUS FOR PATTERN DYEING OF TEXTILE SUBSTRATES

[75] Inventors: Scott C. Miller; Frank W. Teaster; Matthew R. Walker, all of LaGrange, Ga.

[73] Assignee: Milliken & Company, Spartanburg, S.C.

[21] Appl. No.: 09/264,457

[22] Filed: Mar. 8, 1999

[51] Int. Cl.[7] ..... D06P 5/00

[52] U.S. Cl. ..... 8/483; 8/149.1; 8/151; 8/158; 8/485; 8/685; 8/917; 8/929; 8/932; 68/5 D; 68/205 R

[58] Field of Search ..... 8/149, 149.1, 151, 8/158, 483, 485, 685, 917, 929, 932, 934; 68/5 D, 5 E, 205 R

[56] References Cited

U.S. PATENT DOCUMENTS

| | | | |
|---|---|---|---|
| 3,945,791 | 3/1976 | Bohrn | 8/929 X |
| 3,958,925 | 5/1976 | Fleissner | 8/485 X |
| 4,055,868 | 11/1977 | O'Neill, Jr. | 8/150 |
| 4,146,362 | 3/1979 | Nichols, Jr. | 8/1 X |
| 4,338,090 | 7/1982 | Hutcheson | 8/478 |
| 4,361,019 | 11/1982 | Maund | 68/205 R X |
| 4,578,836 | 4/1986 | Otting et al. | 8/151 |
| 4,580,304 | 4/1986 | Otting et al. | 8/151 |
| 4,622,042 | 11/1986 | Nichols, Jr. | 8/478 |
| 4,790,043 | 12/1988 | Chappell | 8/151 |
| 5,199,126 | 4/1993 | Fuller | 8/151 |
| 5,201,959 | 4/1993 | Fuller | 68/9 |

FOREIGN PATENT DOCUMENTS

| | | | |
|---|---|---|---|
| 51-47185 | 4/1976 | Japan . | |
| 60-199987 | 10/1985 | Japan . | |
| 2084515 | 4/1982 | United Kingdom | 8/483 |

*Primary Examiner*—Philip R. Coe
*Attorney, Agent, or Firm*—Terry T. Moyer; George M. Fisher

[57] ABSTRACT

A method and apparatus for pattern dyeing of textile substrates in which the dyeing is done in two stages. In the first stage, a dye is uniformly applied in a manner that allows the dye to fix on contact. The uniformly dyed substrate is then moved under a series of spaced arrays, each array being associated with a separate color and being comprised of a plurality of individually controlled liquid dye applicators. Liquid dye of a given color is selectively applied through one or more dye applicators as the substrate passes under the array associated with that color. The applied dye remains unfixed until the substrate passes under all the arrays and the patterning is complete, whereupon all dye applied by the dye applicators is fixed by steaming or other appropriate application of energy to the substrate.

3 Claims, 2 Drawing Sheets

PROCESS AND APPARATUS FOR PATTERN DYEING OF TEXTILE SUBSTRATES

This invention relates to the pattern dyeing of textile substrates. In particular, this invention relates to the pattern dyeing of substrates using a series of computer controlled dye applicators, arranged in successive arrays, that pattern a substrate after the substrate has been uniformly pre-dyed and fixed in a single step.

BACKGROUND OF THE INVENTION

Computer controlled techniques for the pattern dyeing of substrates are well known. For example, the following commonly assigned U.S. Pat. No. 4,055,868 (O'Neill, Jr.), U.S. Pat. No. 4,111,012 (Stewart, Jr.), and U.S. Pat. No. 5,208,592 (Johnson, Jr.), all hereby incorporated by reference herein—disclose the patterning of substrates in which a series of arrays are arranged in spaced, parallel relation across the path of a moving substrate web. Each array is comprised of a plurality of individually controlled dye applicators or jets, all of which are supplied with dye of a color that is different and specific for each array. As the substrate passes each of the arrays, the dye applicators of that array are individually actuated by a computer containing stored pattern data. The result is that the various dye applicators in each array apply, via a controlled stream or spray, the liquid dye associated with that array in the quantity and configuration necessary to construct, color by color, the desired pattern as the moving substrate passes each array. Because the dye is not fixed until all patterning is complete, the in situ blending of dyes from different arrays may be controlled to generate, as desired, colors that are mixtures of the colors of the individual dyes.

This patterning technique, while offering many advantages over other patterning techniques in commercial use at this time, nevertheless has been the subject of further development. The results of that development are improvements in the following areas.

Occasionally, while attempting to dye a section of substrate a single, solid color, the above-described technique will generate unwanted streaks or other undesirable shading differences, either across the width of the substrate or along its length. Also, because the range of colors that may be deposited on the substrate is necessarily limited by the number of arrays (and therefore the number of available colors of liquid dye), it is sometimes necessary to change the color of dye in one or more arrays to allow the reproduction of a specified color that cannot be obtained using the combination of available liquid dyes.

This process requires time consuming steps to remove the old dye, thoroughly clean the array so that the old color dye does not contaminate the new color dye, refill the array with the new dye, and resume the dyeing operation. Therefore, any technique that allows for the reproduction of a wider range of colors from a given set of liquid dyes is very desirable if production delays are to be minimized. Furthermore, any technique that allows for an increase in the speed at which the substrate can pass under the arrays, with no adverse effect upon the quality of the resulting pattern, is also very desirable, as it will tend to increase product throughput. The invention disclosed herein offers these advantages, as well as others that will be discussed in, or become apparent from, the following disclosure. The above comments are believed to apply to other similar discrete dye applicator patterning devices. One such device is described in commonly assigned U.S. Pat. No. 4,923,743 to Stewart, Jr., which is hereby also incorporated by reference.

The instant invention combines the advantages of computer-controlled patterning, as described above, with known textile dyeing techniques in which a heated liquid dye of a single color is applied to a substrate in a way that allows the dye to become fixed in the substrate without the need for any additional steaming or other fixation step. Such a technique is described generally in, for example, U.S. Pat. No. 4,790,043 to Chappell and U.S. Pat. No. 4,578,836 to Otting, et al. This single step dyeing technique is used herein in connection with the uniform application of a single light, neutral shade to the substrate to be patterned. As so used, this or similar single step dyeing techniques in which the dye is fixed on contact shall be referred to generically herein as the solid shade dyeing technique, and the specific apparatus used to implement this technique shall be referred to as the solid shade dyer.

In the instant invention, the solid shade dyeing technique described above is used before any patterning of the substrate takes place. In this process the carpet is dyed a solid, relatively neutral shade (e.g., a light beige) in a way that makes unnecessary a separate dye fixation step for the solid shade. This is achieved by applying hot dye in a way that prevents the dye from cooling before it strikes the substrate surface. By using heated dye and applying it in an environment in which cooling effects such as evaporative cooling, heat dissipation in the substrate, etc. may be minimized, the uniformly applied dye can fix to the substrate on contact, without the need for subsequent steaming or other conventional fixing techniques.

Unexpected advantages have been observed when these two technologies are combined. By applying the patterning dye to a substrate to which dye has already been uniformly applied and fixed, the quantity of dye needed to pattern the substrate is appreciably reduced, thereby reducing dye costs and allowing the substrate to be moved much more rapidly past the patterning arrays and dramatically increasing the throughput of the machine. Perhaps more importantly, the dyed quality of the patterned areas is improved—the dyed areas are dyed more uniformly, with cleaner interfaces between adjacent dyed areas, when compared with patterned substrates that were not previously subject to the solid shade dyeing step described above.

Yet an additional advantage is that this development makes possible the practical manufacture of carpet tile starting with broadloom carpet. Ordinarily, the normally insignificant side-to-side or side-center-side shade differences associated with dye jet patterning of the kind described above precludes cutting carpet tiles from broadloom carpet because of the need for extensive sorting of carpet tiles at the time of packaging or installation. This sorting step has been found necessary to prevent gradual shifts in shade that might occur in the course of a given production run—and that might be imperceptible if viewed over a relatively large expanse of broadloom carpet—from being emphasized through the chance side-by-side placement of tiles, cut from widely separated areas of the broadloom carpet, that reflect the extremes of the shade shift that occurred within that production run. Thus, to assure reasonable tile-to-tile shade uniformity at the time of installation, generally it has not been commercially practical to use broadloom to generate carpet tiles. This invention removes this obstacle.

The reasons for these unexpected advantages are not yet fully understood. It is known, however, that treating the substrate with steam or water (with or without surfactants) prior to pattern dyeing does not yield the same improvement, so it is not merely the effects of a moist or heated substrate.

It is conjectured that the fibers comprising the substrate are bulked in a consistent way, with uniform moisture imparted to the fibers, thereby resulting in a more dependably uniform receiving surface for the patterning dye. It is also conjectured that, because fewer dye sites are available (due to the presence of the "neutral"-color dye on the fibers), less dye is required to achieve a deep, uniform color than would be necessary without the solid shade dyeing step.

BRIEF DESCRIPTION OF THE DRAWINGS

These and other features of the invention will become more apparent from the following detailed description of the preferred embodiments of the invention, when taken along with the accompanying drawings in which.

DETAILED DESCRIPTION OF A PREFERRED EMBODIMENT

Figure 1:
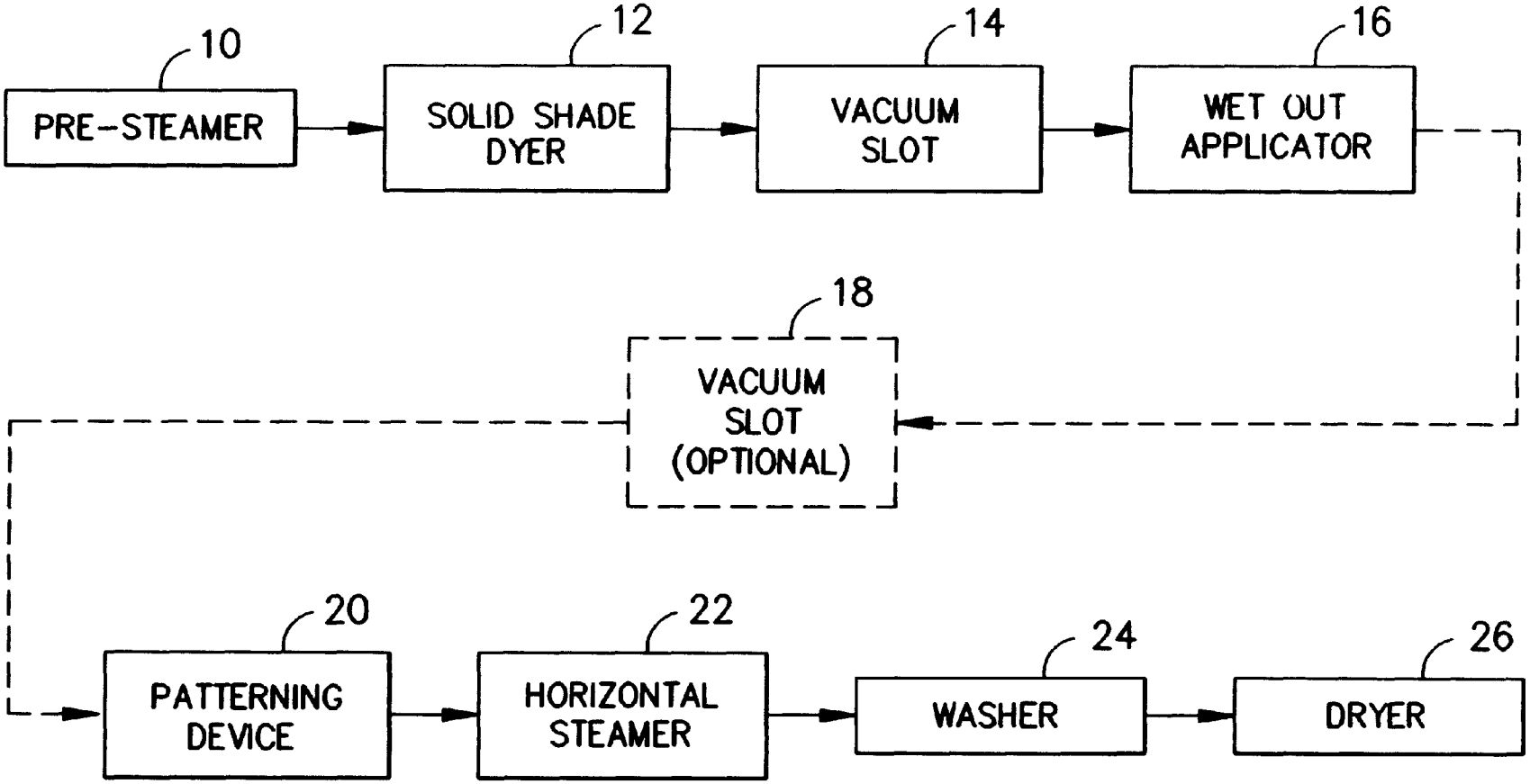
FIG. 1 is a block diagram of a substrate pattern dying process or apparatus sequence embodying the instant invention.

FIG. 1 represents a schematic depiction of the separate process steps or equipment sequence used in one embodiment of this invention. A textile substrate to be patterned, not shown, is first subjected to a conventional pre-steamer, depicted at 10, which serves to bulk the yarn in the substrate in preparation for the solid shade dyeing stage 12. The solid shade dyeing stage depicted at 12 may be carried out using various commercially available devices, so long as the devices are capable of uniformly applying and fixing a dye to a textile substrate in a single step. One way this can be achieved is by heating the dye, and applying uniformly the hot dye to the substrate in a way that allows the hot dye to fix on the substrate with no additional input of energy, as from a subsequent steaming step. For example, the dye may be applied by a series of individual nozzles or applicators that are effectively placed in close proximity to, or in contact with, the surface of the substrate. The nozzles or applicators, in turn, may be surrounded by an enclosure that allows the substrate to pass by or contact the nozzles or applicators. At the same time, the enclosure serves to prevent the dissipation of the thermal energy carried by the heated dye. The result is the dye is sufficiently hot as it contacts the substrate that it fixes almost instantaneously (actually, within a few seconds) after contacting the substrate, with no additional input of energy.

Figure 2:
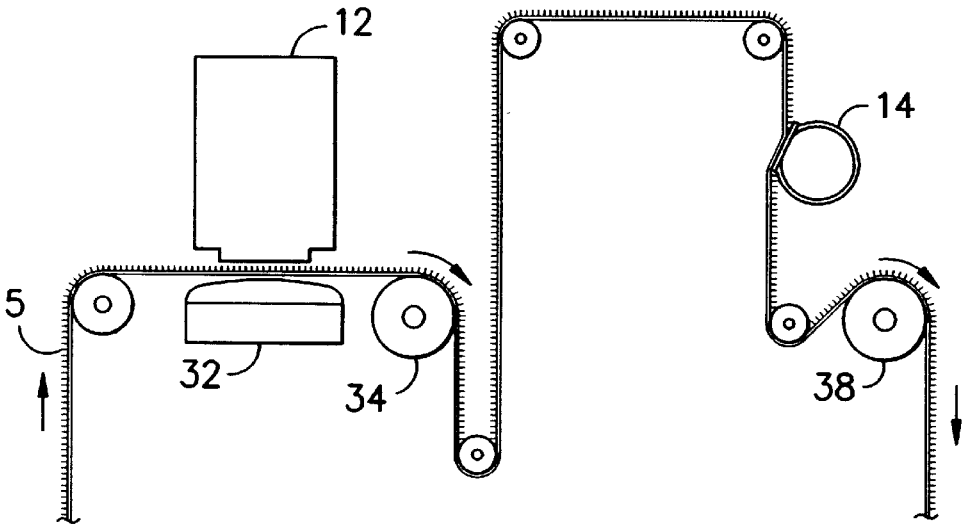
FIG. 2 is a cross-sectional schematic depiction of a solid shade dyer of a kind that may be used to practice the instant invention.

One such arrangement, which is readily available commercially, is schematically depicted in FIG. 2. Here, the substrate web 5 passes between solid shade dyer 12 and a pneumatically actuated pressure pad or bellow 32. This arrangement allows the substrate to contact the dye applicator orifice portion of dyer 32 that is positioned directly opposite bellow 32, and allows the applied heated dye to fix upon contact with the substrate.

An alternative solid shade dyeing arrangement, also using heated dye, is described in detail in previously mentioned U.S. Pat. No. 4,790,043 to Chappell, the disclosure of which is hereby incorporated by reference. It is believed other means or techniques, such as using heated substrates to achieve or enhance dye fixation, would also be satisfactory under appropriate circumstances.

It has been found most effective for subsequent patterning if the color chosen during the solid shade dyeing step is relatively light and relatively neutral. Accordingly, light shades of gray or beige, particularly the latter, are preferred, although other colors and shades may be preferable, depending upon the palette of colors to be used in the patterning step and the overall patterning effect desired.

Following the uniform application and fixing of dye on the substrate in the solid shade dyeing step, the substrate is next passed over a vacuum slot or other means 14 to remove excess moisture, such as water and condensation resulting from the dyeing operation. Following this step, the substrate is prepared for the pattern dyeing step by the application of surfactants and other chemicals useful in achieving deep color penetration and distinct patterns when the patterns are applied to the substrate using highly localized, discrete streams of ambient temperature liquid dye. The exact mix of chemicals will depend upon a number of factors, including the nature of the substrate, the nature and operating parameters of the patterning device used, the nature and viscosity of the dye, and other factors. The manner in which these chemicals are applied, as depicted at 16, is not critical, so long as the degree of wet pickup is satisfactory and the previously dyed surface is not adversely affected. Depending upon the results of this step, an additional, optional vacuuming stage 18 or the like may be used to remove excess moisture from the substrate prior to patterning.

Figure 3:
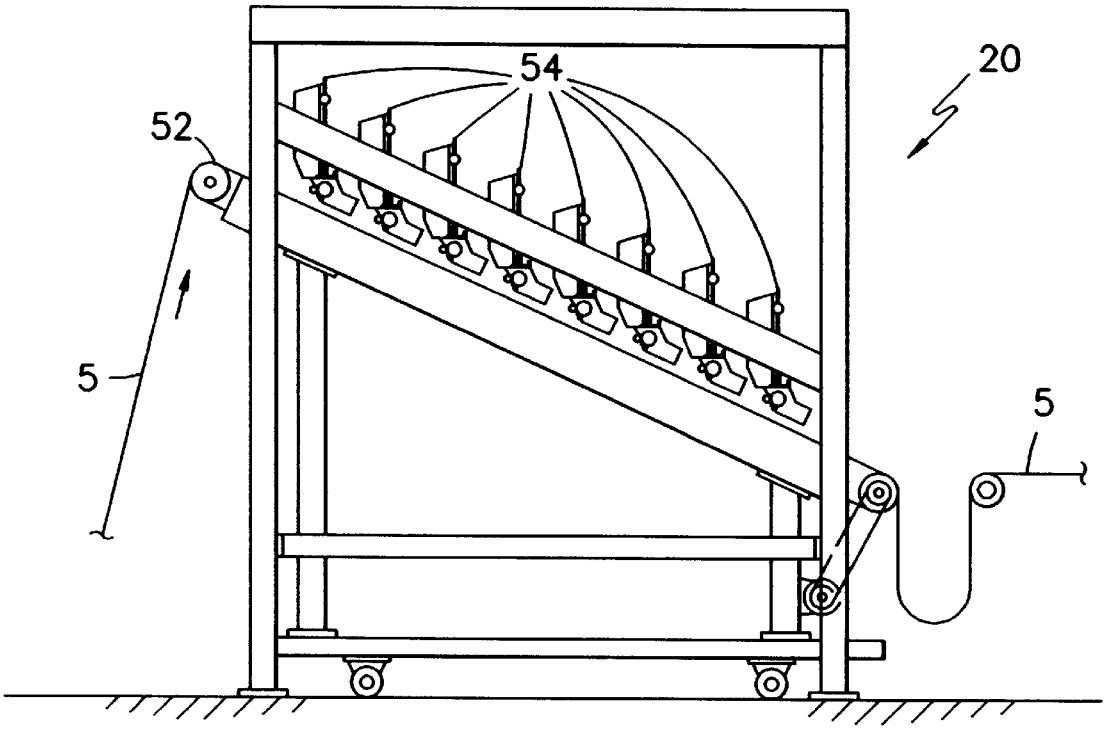
FIG. 3 is a schematic diagram of a textile patterning device that uses a plurality of computer controlled discrete streams of liquid dye arranged in a series of color-specific arrays that span the path of the moving substrate to be patterned; it represents one example of a patterning means useful in the practice of the instant invention.

Following this step, the substrate is introduced to a dye jet patterning device 20, such as depicted in FIG. 3. Substrate 5 is passed over roll 52 and onto a conveyer system that allows the substrate to pass before a series of dye applicator arrays 54. Each array is fed from a separate dye supply system, and applies a different color dye. Accordingly, the eight arrays shown would provide for the use of an eight color palette. It should be remembered, however, that a great many more than eight colors can be generated on the substrate, due to various color mixing and blending techniques. The details of the device are not believed to be critical. It should be noted that both the substrate, as it passes through patterning device 20 and the dye applied to the substrate in patterning device 20 are essentially at ambient temperature. No effort is made to introduce thermal or other forms of energy into the dyeing process in an effort to fix, either fully or partially, any of the patterning dye until the patterning of the substrate is complete and the substrate leaves patterning device 20.

Following this patterning operation, the substrate is sent, in turn, to a steamer 22, in which the dyes applied during the patterning step are fixed, then to a washer 24, where excess dyeing chemicals such as those applied at 16 may be removed, and finally to a dryer 26, where the substrate may be dried (see FIG. 1). All of these devices 22, 24, and 26 may be of any appropriate design.

It has been found that postponing the fixing of the patterning dye until the patterning is complete provides an opportunity to create an extremely rich and broad variety of color effects due to the ability to mix and blend different dyes after they have been deposited on the substrate. For example, an area on the substrate carrying unfixed dye from one of the applicator arrays can be the target of a different color dye from another of the applicator arrays, thereby providing for the in situ blending of the two different unfixed dyes. Similarly, the target for the different color dye can be selected near the edge of a previously dyed area, thereby providing for in situ dye diffusion primarily along a boundary between the two unfixed dye areas.

Because the initial solid shade is of a light, neutral color, it lends itself quite well to providing a fixed, aesthetically pleasing background against which the effects of the patterning dyes, singly and in blended combinations, can be displayed, and also appears to contribute visually and aesthetically, if not physically, to the in situ blending of the various patterning dyes on the substrate.

EXAMPLE 1

A web of broadloom, loop pile carpet comprised of nylon 6,6 and having a face weight of about 20 oz./sq. yd. is directed at a linear speed of about 68 ft./min. (which speed is substantially maintained throughout the processes shown in FIG. 1) through a pre-steamer of conventional design, under the following operating conditions: steam rate: 225 lb./hr.; residence time: 2.5 seconds. The web is then directed into a solid shade dyer, specifically a Küsters Fluidyer™ Typ KDA-2000, distributed by Zima Corporation of Spartanburg, S.C. Acid pre-metallized dye is heated and uniformly applied, in accordance with the manufacturer's instructions, in a manner that causes the dye to fix on contact with the carpet. The dye is heated to a temperature between 140° F. and 180° F., and preferably within the range of 140° F. to 160° F. The bellow pressure is about 0.2 bar (gauge). Wet pickup is in the range of 350% to 500%, and preferably within the range of 400% to 450%. The carpet moves from the solid shade dyer to a vacuum slot of conventional design, operating at about 8 inches Hg, where excess water is removed. The carpet is then directed to a "dip-and-nip"-type applicator where conventional surfactants, viscosity modifiers, and other chemicals may be added, at ambient temperature, that will enhance the ability of the patterning dye to be absorbed by the carpet fibers without excessive migration, which tends to reduce pattern sharpness and detail. In this Example, a cationic polymer solution marketed as Polycat M-30, and available from Peach State Labs, Inc. of Rome, Ga. is used. Wet pickup at this stage is between 50% and 100%. The carpet is at essentially ambient temperature.

The prepared carpet is then directed to a computer-controlled patterning device of the kind described generally in FIG. 3 and the patents to O'Neill, Jr., Stewart, Jr., and Johnson, Jr., referenced above. The carpet is passed under a series of arrays of individually controlled dye applicators, where acid pre-metallized dyes of different colors and at ambient temperatures are applied in a pattern configuration without dye fixation occurring. Typical maximum dye flow rates are on the order of 50 ml/min/applicator. In this Example, the dyes were mixed with Kelzan S, a xanthan gum-containing product available from Kelco Biopolymers, a division of Monsanto, of St. Louis, Mo.

Following this patterning step, the carpet is directed to a steamer of conventional design, where the patterning dyes are fixed. Typical operating parameters for the steamer are as follows: temperature: 210° F.; residence time: 3 minutes. After the patterning dyes are fixed, the carpet is directed to a washer of conventional design, comprised of a series of spray bars and vacuum slots, manufactured by TVE Escale Textile Machinery, of Flowery Branch, Ga. The chemicals that were applied by the "dip-and-nip" prior to the patterning step are washed from the carpet, and the carpet is dried in a conventional dryer, such as made by American Monforts Corporation, of Charlotte, N.C. to the desired moisture content, generally between 4% and 6%.

The resulting patterned carpet shows exceptional color depth and uniformity, with no perceptible streaking or other shade differences across or along the web. A reduced quantity of patterning dye (typically 20 to 40%) is needed, and carpet throughput is increased (typically 50 to 70%), compared with similar patterns run without the solid shade dyer.

EXAMPLE 2

The same process of Example 1, using the same carpet, equipment, chemistry, and operating parameters, is carried out, except that no dye is used in the solid shade dyer. Instead, water is substituted for the dye. The resulting patterned carpet, when compared to the carpet of Example 1, shows inferior color depth and uniformity, with perceptible streaking or other shade differences across or along the web. The quantity of patterning dye needed is significantly increased over that of Example 1, and maximum substrate speed through the patterning device is dramatically reduced.

EXAMPLE 3

The same process of Example 1, using the same carpet, equipment, chemistry, and operating parameters, is carried out, except that the carpet is comprised of nylon 6. The results are similar to those of Example 1.

While these examples involve carpeting, and the invention is believed to be especially advantageous when used with carpet or other textile substrates having a distinct pile-like surface, it is believed that this invention is not so limited, and can be used with advantage in the patterning of a wide variety of textile substrates. For example, it is believed that substrates comprised of wool, or combinations of nylon and wool, can readily be substituted for those of nylon in the above examples, with substantially similar results. It is also believed that, with appropriate adjustments in the dye chemistry that would be apparent to those of ordinary skill, substrates comprised of polyester, polypropylene, or combinations thereof, can be used with advantage.

Having described the principles of my invention in the form of the foregoing exemplary embodiments, it should be understood by those skilled in the art that the invention can be modified in arrangement and detail without departing from such principles, and that all such modifications falling within the spirit and scope of the following claims are intended to be protected hereunder.

We claim:

1. A process for dyeing a textile substrate in a multicolored pattern, said process comprising the steps of a. applying uniformly a hot dye to said substrate in a manner that allows said dye to fix immediately upon contact with said substrate, thereby creating a uniformly dyed substrate on which said dye is fixed;

b. moving said uniformly dyed substrate past a series of spaced arrays, each array being associated with a liquid patterning dye of a specific color, and each array being comprised of a plurality of individually controlled liquid patterning dye applicators directed towards the path of said moving substrate;

c. patterning said uniformly dyed substrate by selectively actuating said liquid patterning dye applicators in at least one of said arrays to apply said liquid patterning dye, in pattern configuration and in a manner that does not fix said applied patterning dye upon contact, to said uniformly dyed substrate as said substrate passes said one array;

d. repeating said patterning step as necessary to apply liquid patterning dye from as many arrays as is necessary to produce the desired pattern on said uniformly dyed substrate; and applying energy to said patterned substrate to fix said liquid patterning dye.

2. The process of claim 1 wherein said textile substrate is a carpet comprised of a fiber selected from the group consisting of nylon 6, nylon 6,6, and wool and wherein said hot dye and said patterning dye are acid pre-metallized dyes.

3. An apparatus for dyeing a textile substrate in a multicolored pattern, said apparatus comprising:

a. means for applying uniformly a hot dye to said substrate in a manner that allows said dye to fix immediately upon contact with said substrate, thereby creating a uniformly dyed substrate;

b. means for moving said uniformly dyed substrate past a series of spaced arrays, each array being associated with a liquid patterning dye of a specific color, and each array being comprised of a plurality of individually controlled liquid patterning dye applicators directed towards the path of said moving substrate;

c. means for patterning said uniformly dyed substrate by selectively actuating said liquid patterning dye applicators in at least one of said arrays to apply said liquid patterning dye, in pattern configuration and in a manner that does not fix said applied patterning dye upon contact, to said uniformly dyed substrate as said substrate passes said one array;

d. means for applying energy to said patterned substrate to fix said patterning dye applied in said pattern configuration.

* * * * *